US006948398B2

(12) United States Patent
Dybro

(10) Patent No.: US 6,948,398 B2
(45) Date of Patent: Sep. 27, 2005

(54) JOYSTICK WITH ENABLING SENSORS

(75) Inventor: Niels Dybro, Reinbeck, IA (US)

(73) Assignee: Deere & Company, Moline, IL (US)

( * ) Notice: Subject to any disclaimer, the term of this patent is extended or adjusted under 35 U.S.C. 154(b) by 213 days.

(21) Appl. No.: 10/200,385

(22) Filed: Jul. 22, 2002

(65) Prior Publication Data

US 2004/0011154 A1 Jan. 22, 2004

(51) Int. Cl.[7] ..... G05G 13/00

(52) U.S. Cl. ..... 74/471 XY; 74/473.12; 180/272; 172/170; 227/8

(58) Field of Search ..... 74/471 XY, 473.12, 74/335; 200/61.88; 192/3.62, 131, 13 R; 180/272, 333; 173/2, 170, 171; 227/8

(56) References Cited

U.S. PATENT DOCUMENTS

| | | | | | |
|---|---|---|---|---|---|
| 3,707,093 | A | | 12/1972 | Worden | |
| 3,909,625 | A | | 9/1975 | Colglazier et al. | |
| 4,051,915 | A | * | 10/1977 | Behrens | 180/271 |
| 4,450,325 | A | | 5/1984 | Luque | |
| 4,656,461 | A | | 4/1987 | Heidelberger et al. | |
| 4,794,273 | A | * | 12/1988 | McCullough et al. | 307/139 |
| 4,914,721 | A | * | 4/1990 | Glaeser et al. | 307/116 |
| 5,112,184 | A | | 5/1992 | Tapper et al. | |
| 5,293,900 | A | * | 3/1994 | Karbassi et al. | 137/554 |
| 5,319,250 | A | * | 6/1994 | Windsor | 307/139 |
| 5,341,036 | A | * | 8/1994 | Wheeler et al. | 307/328 |
| 5,425,431 | A | | 6/1995 | Brandt et al. | |
| 5,526,915 | A | * | 6/1996 | Bessette et al. | 192/130 |
| 5,566,586 | A | | 10/1996 | Lauer et al. | |
| 5,583,386 | A | * | 12/1996 | Meixner et al. | 307/326 |
| 5,588,593 | A | * | 12/1996 | Boisture | 239/67 |
| 5,711,391 | A | | 1/1998 | Brandt et al. | |
| 5,856,646 | A | | 1/1999 | Simon | |
| 6,047,634 | A | * | 4/2000 | Futsuhara et al. | 100/43 |
| 6,051,894 | A | | 4/2000 | Shimogama | |
| 6,079,738 | A | | 6/2000 | Lotito et al. | |
| 6,135,230 | A | | 10/2000 | Schenck et al. | |
| 6,152,676 | A | | 11/2000 | Evert et al. | |
| 6,178,841 | B1 | | 1/2001 | Ruckert et al. | |
| 6,348,911 | B1 | * | 2/2002 | Rosenberg et al. | 345/161 |
| 6,471,106 | B1 | * | 10/2002 | Reining | 227/8 |
| 6,681,880 | B2 | * | 1/2004 | Bernhardt et al. | 180/315 |

FOREIGN PATENT DOCUMENTS

| | | |
|---|---|---|
| DE | 199 34 186 | 1/2001 |
| EP | 0 701 917 | 3/1996 |

OTHER PUBLICATIONS

John Deere Model 700H Brochure, 19 pages.
John Deere Model 450H 550H 650H Brochure, 28 pages.
PCT Search Report, 6 pages, Oct. 20, 2003.

* cited by examiner

*Primary Examiner*—David M. Fenstermacher

(57) ABSTRACT

A multi-axis vehicle control device or "joystick" includes one or more sensors defining discrete sensor zones on the handle portion thereof. The sensors are operative to passively detect the presence of a person or object in the vicinity of the handle. Location of the sensor zones in the regions of the handle engaged by the thumb and fingers of the operator's hand during normal operation allows the sensors to detect when the operator has manually engaged the joystick for normal operation. The sensors are in communication via a logic circuit to the actuator circuitry so that the actuator portion of the joystick is enabled only when a presence is detected in the discrete sensor zones and disabled when no presence is detected. The use of such sensors greatly reduces the risk of inadvertent actuation of the joystick and the associated safety hazards, while maintaining the positive ergonomic characteristics of the joystick.

17 Claims, 2 Drawing Sheets

JOYSTICK WITH ENABLING SENSORS

FIELD OF THE INVENTION

The present invention relates generally to vehicle controllers. More particularly, the present invention relates to multi-axis vehicle control levers, also known as joysticks, which are frequently found in agricultural and construction machinery. Specifically, the present invention relates to multi-axis vehicle control levers having safety interlocks to prevent inadvertent actuation of the control lever.

BACKGROUND OF THE INVENTION

Previously it has been known in the art to utilize multi-axis vehicle control levers, also known as "joysticks", in the operators station of prime movers in the agricultural and construction industries for controlling various vehicle and/or implement functions. It is also known that inadvertent actuation of such a control lever poses both a significant safety hazard to the vehicle operator and others who may be in the vicinity of the vehicle, as well as a risk of damage to property. Inadvertent actuation of the controller is most likely during entrance to and/or egress from the operators station, at which time the operator is more likely to be harmed by the inadvertent actuation and less able quickly to regain control of the vehicle. The likelihood of inadvertent actuation is often further increased due to the location of the joystick. The choice of location for the joystick is frequently driven by ergonomic considerations for the seated operator. Thus, locating the joystick so as to minimize the chance of inadvertent actuation during entrance to and/or egress from the vehicle would compromise the ergonomics of the lever for the properly seated operator.

In the past, attempts to mitigate the problem of inadvertent actuation have included the use of rather stiff operating joysticks which are less susceptible to inadvertent actuation. However, the use of such joysticks likewise compromises the ergonomics for the operator due to the increased fatigue associated with manipulating the lever for extended periods of time. It has also been proposed to use mechanical or electromechanical interlocks to enable the joystick for normal operation. This solution requires that the operator depress a lever or button while gripping the joystick in order for the joystick to work. Such a system provides the operator with little freedom in gripping the joystick and causes fatigue during prolonged operation.

Accordingly, there is a clear need in the art for an ergonomic multi-axis vehicle control lever that is enabled only when the operator is gripping the lever in a manner consistent with normal operation, thus obviating the possibility of inadvertent actuation of the lever while maintaining the positive ergonomic characteristics thereof.

SUMMARY OF THE INVENTION

In view of the foregoing, it is an object of the invention to provide a multi-axis vehicle control lever.

Another object of the invention is the provision of such a control lever which has positive ergonomic characteristics for the vehicle operator.

A further object of the invention is to provide such a control lever which is operatively enabled only when the operator is gripping the lever in a manner consistent with normal operation, thereby obviating the possibility of inadvertent actuation thereof.

The foregoing and other objects of the invention together with the advantages thereof over the known art which will become apparent from the detailed specification which follows are attained by a multi-axis control device comprising a lever operatively connected to an actuator, the lever having a handle portion and at least two sensor zones located at the handle portion for operatively enabling the actuator when the handle portion of the lever is manually engaged in a manner consistent with normal operation thereof.

Other objects of the invention are attained by a vehicle control device comprising: a lever operatively connected to an actuator, the lever having a handle portion; and, at least one sensor located at the handle portion, the sensor defining at least two sensor zones in a vicinity of the handle portion, wherein the sensor passively detects a presence in the sensor zones, the sensor being in communication with the actuator so as to operatively enable the actuator when a presence is detected in at least two sensor zones and operatively disable the actuator when no presence is detected in the sensor zones.

Still other objects of the invention are attained by a multi-axis control device comprising an actuator operatively connected to a lever having a handle portion, a plurality of sensors located on the handle portion the sensors defining discrete sensor zones in a vicinity of the handle portion and communicating with the actuator to operatively enable the actuator when a presence is detected in the sensor zones and to operatively disable the actuator when no presence is detected in the sensor zones whereby the actuator is only enabled when the handle is manually engaged in a manner consistent with normal operation of the control device.

In general, a multi-axis vehicle control device or "joystick" includes one or more sensors defining discrete sensor zones on the handle portion thereof. The sensors are operative to passively detect the presence of a person or object in the vicinity of the handle. Location of the sensor zones in the regions of the handle engaged by the thumb and fingers of the operator's hand during normal operation allows the sensors to detect when the operator has manually engaged the joystick for normal operation. The sensors are in communication via a logic circuit to the actuator circuitry so that the actuator portion of the joystick is enabled only when a presence is detected in the discrete sensor zones and disabled when no presence is detected. The use of such sensors greatly reduces the risk of inadvertent actuation of the joystick and the associated safety hazards, while maintaining the positive ergonomic characteristics of the joystick.

To acquaint persons skilled in the art most closely related to the present invention, one preferred embodiment of the invention that illustrates the best mode now contemplated for putting the invention into practice is described herein by and with reference to, the annexed drawings that form a part of the specification. The exemplary embodiment is described in detail without attempting to show all of the various forms and modifications in which the invention might be embodied. As such, the embodiment shown and described herein is illustrative, and as will become apparent to those skilled in the art, can be modified in numerous ways within the spirit and scope of the invention—the invention being measured by the appended claims and not by the details of the specification.

BRIEF DESCRIPTION OF THE DRAWINGS

For a complete understanding of the objects, techniques, and structure of the invention reference should be made to the following detailed description and accompanying drawings, wherein.

DESCRIPTION OF THE PREFERRED EMBODIMENT

Figure 1:
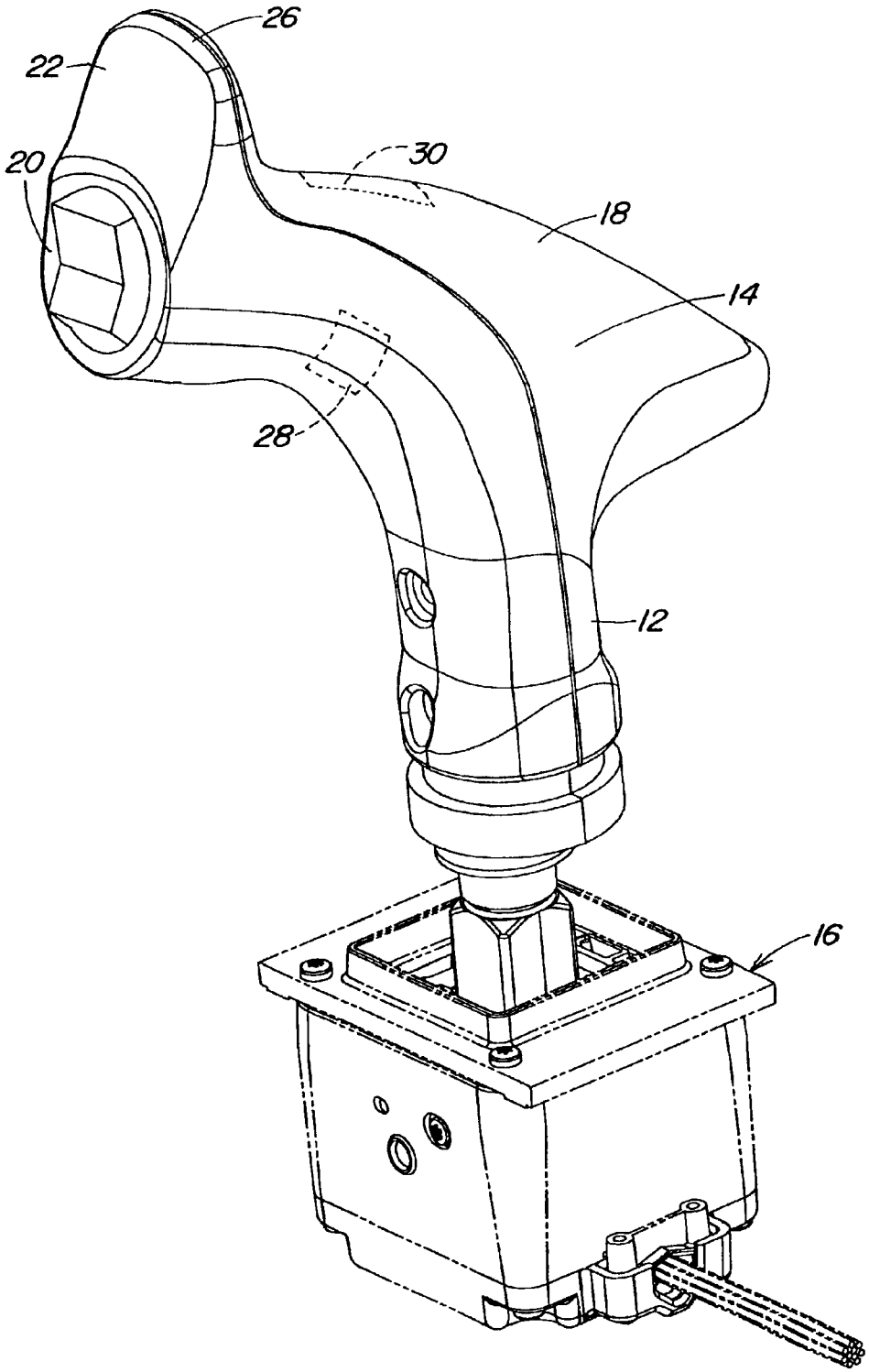
FIG. 1 is a left rear perspective view of a representative joystick according to the invention; and, FIG. 2 is a right rear perspective view of the same representative joystick according to the invention.
Figure 2:
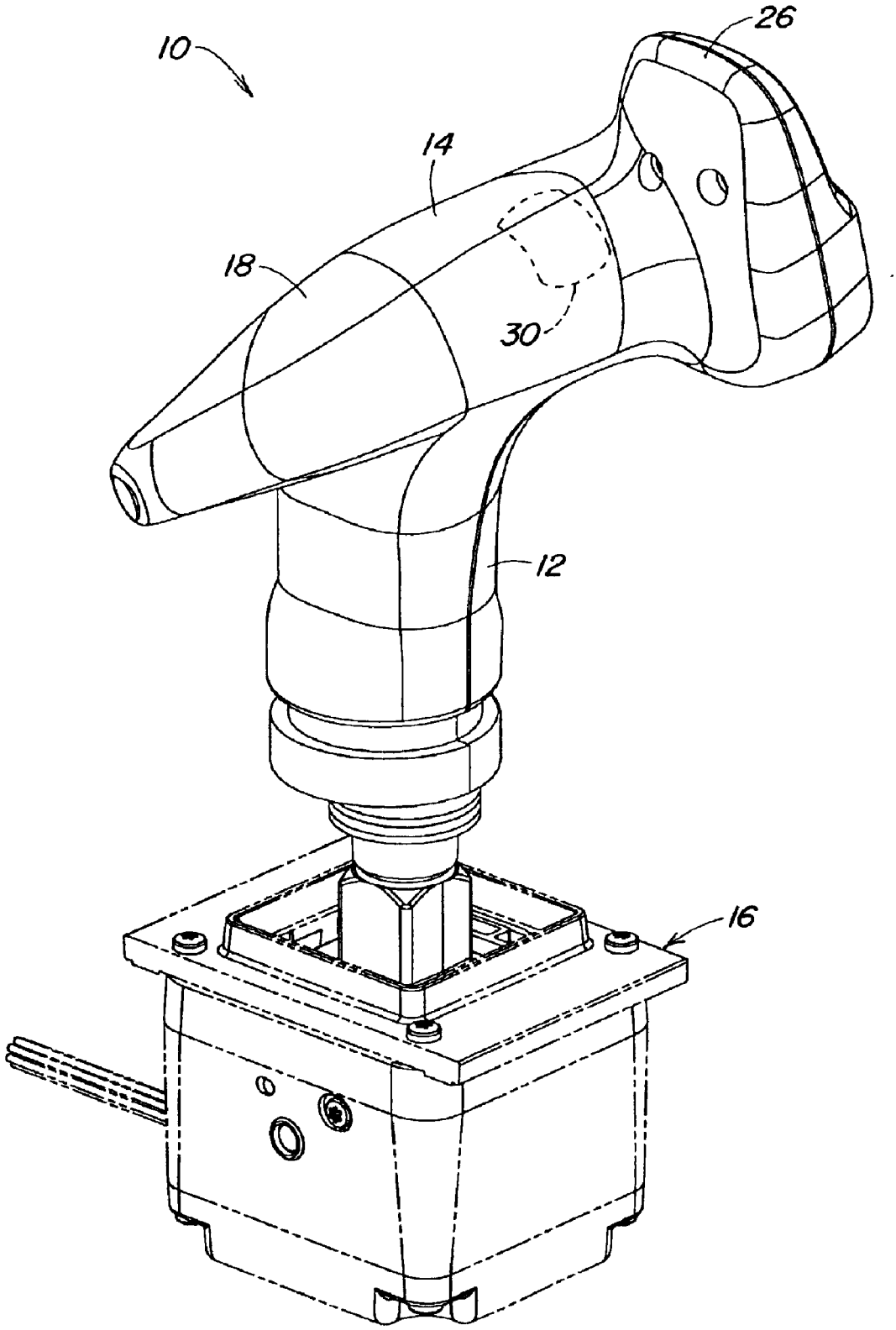

With reference now to the drawings it will be seen that a multi-axis vehicle control lever, hereinafter referred to as a joystick, is designated generally by the number 10. Joystick 10 is predominately comprised of a cylindrical shaft portion 12 and an ergonomically contoured handle portion 14. Shaft portion 12 is typically disposed vertically when installed in a vehicle and is operatively connected to an actuator 16. Handle portion 14 is disposed at an angle relative to shaft portion 12 for reasons which will become apparent as the detailed description continues.

Handle portion 14 is further comprised of a hand rest 18, a primary thumb area 20 and a secondary thumb area 22. As can be seen hand rest 18 is a widened curvilinear platform which generally defines the top of joystick 10. In the representative embodiment primary thumb area 20 is characterized by the presence of a thumb switch 24. While thumb switch 24 is not an essential element of the invention, it is illustrated in the accompanying drawings to demonstrate the ergonomic characteristics of a representative joystick as they relate to the invention. Thumb switch 24 as well as additional switches (not shown) can be used for activating functions dictated by the specific application in which the joystick is employed and may or may not be included on a joystick as contemplated by the invention without departing from the spirit thereof. Secondary thumb area 22 is defined by a lug 26 extending generally perpendicular to hand rest 18 in the region directly above thumb switch 24.

In use a representative control device such as joystick 10 may be mounted in a vehicle console adjacent to an armrest so as to allow the vehicle operator to rest his or her arm and simultaneously engage the joystick. In such a configuration the operator could then engage joystick 10 by placing an open palm on hand rest 18 with the thumb disposed on the opposite side of lug 26 so as to permit the operator to manipulate thumb switch 24 in primary thumb area 20. When not engaging thumb switch 24 the thumb can be rested in secondary thumb area 22. Joystick 10 can thus be manipulated by slight hand movements accompanying light pressure on hand rest 18 and lug 26. It should be readily apparent to those skilled in the art that the representative joystick depicted in the drawings is designed for right hand operation. A left handed version of the joystick would essentially be a mirror image of the device pictured. The description herein is equally applicable both to left and right handed configurations.

A novel feature of the invention disclosed herein is the provision of passive means for enabling the joystick for operation only when the operator is manually engaging the joystick in a manner consistent with normal operation. The provision of such means serves to prevent inadvertent actuation of the joystick. More particularly, a first sensor zone 28 is located on handle portion 14 in the region adjacent to the primary and secondary thumb areas 20 and 22 respectively. Based upon the foregoing description of the joystick structure, those skilled in the art will recognize that the location of first sensor zone 28 in the region indicated in the drawings corresponds to the first knuckle of the thumb when joystick 10 is manually engaged for normal operation. A second sensor zone 30 is located on hand rest 18 in the area adjacent to lug 26. Accordingly, second sensor zone 30 corresponds to the location of the knuckles of the index and middle fingers of the operator during normal operation of the joystick. Sensor zones 28 and 30 are each defined by proximity sensors embedded beneath the surface of joystick 10. In a preferred embodiment the proximity sensors would comprise capacitive sensors as are well known in the art and frequently employed in various applications where it is desirable to detect the presence of a person or object. An example of such an application is for detecting the presence of an occupant in a vehicle for the purpose of enabling or disabling the vehicle's passive restraint system. Such capacitive sensors typically have plural conductive elements interposed between non-conductive layers. When energized the sensors produce an electric field which extends outwardly from the sensor. Depending on the characteristics of the sensors and the voltages applied to the conductive elements, the field can extend from zero to several feet. When an object is introduced into the field a negative charge is induced on the surface of the object and the object effectively becomes another capacitive element working in conjunction with the other conductive elements. Thus the effective capacitance between the sensor and ground is altered when an object is within the field. The capacitance can then be monitored for changes to detect the presence of an object in the vicinity of the sensor. It is contemplated that sensor zones 28 and 30 could be defined by two discrete capacitive sensors or by a single capacitive sensor having two discrete non-contiguous electric fields.

With capacitive sensors as described above defining first and second sensor zones 28 and 30 respectively, manual engagement of joystick 10 can be detected passively without the need to engage or disengage actively a mechanical or electromechanical switch. Further, by employing discrete sensor zones and capacitive sensors having small electric fields it is possible to limit detection to a distinct presence in a relatively small area as in sensor zones 28 and 30. Thus, first sensor zone 28 would detect the presence of the operator's thumb when joystick 10 is manually engaged for normal operation. Likewise, second sensor zone 30 would detect the presence of the operator's index and middle fingers when joystick 10 is manually engaged in a manner consistent with normal operation.

In the preferred embodiment of the invention the capacitive sensors located in first and second sensor zones 28 and 30 are coupled via logic to the actuator circuitry so as to enable or disable the actuator depending upon certain predetermined conditions. More particularly, the actuator will be enabled only when a presence is detected in both first and second sensor zones at the same time. This AND condition in the logic will awaken the actuator circuitry so as to allow the joystick to be used in a conventional manner. Once the actuator is awakened the logic will revert to a state requiring a continued signal indicating a presence from either one or both sensor zones to remain operative. This AND/OR condition in the logic will provide the operator with greater flexibility in manipulating the joystick. In the event that the operator releases the joystick such that no presence is indicated at either sensor zone the joystick will be disabled and a signal indicating a presence at both first sensor zone 28 and second sensor zone 30 will be required to enable the joystick once again. It is also contemplated that a time delay circuit could be integrated in the joystick logic to delay the enabling and/or disabling of the joystick for a pre-selected time depending upon the application in which the joystick is used. The use of a time delay in enabling the joystick could lessen further the chance of inadvertent actuation. Similarly, the use of a time delay in disabling the joystick provides added convenience for an operator who may have a need to momentarily release the joystick. The logic required for enabling and disabling the actuator in response to a sensed presence or the lack thereof and for a time delay, may be achieved in many ways and is well within the technical ability of persons having ordinary skill in the relevant arts, thus a detailed description of the circuitry is not warranted.

It should now be apparent to those having skill in the art that joystick 10 as described above is much less susceptible to inadvertent actuation than known joysticks particularly those having mechanical interlocks. More particularly, the location of sensor zones 28 and 30 makes it highly unlikely that inadvertent contact with joystick 10 will enable the actuator for operation. While it is possible within the scope of the invention to position the sensor zones at locations other than those shown in the representative embodiment it is preferred to locate the sensor zones in such a way as to minimize the risk that a single inadvertent contact could cover both sensor zones simultaneously. In the representative embodiment this is accomplished by locating first and second sensor zones 28 and 30 so that the fields produced by the capacitive sensors are non-contiguous and directed in substantially diametrically opposite directions. In so doing the joystick is not likely to be enabled as a result of bumping, kicking, brushing against, or other unintentional contact. It should further be apparent that the invention represents a significant improvement over known devices due to the use of sensors which do not require the performance of any discrete act on the part of the operator in order to enable the joystick, beyond that which would otherwise be required to utilize the operative functions of thereof. By simply gripping the joystick in a normal way, the operator enables the joystick for operation and by simply releasing the joystick the operator renders the joystick inoperative and thus safe from inadvertent actuation. The choice of joystick location can now be made based upon where it is most ergonomically practical, not upon where it is least susceptible to inadvertent actuation. The ergonomic characteristics are further enhanced because the capacitive sensors do not require physical contact in order to sense a presence, thereby allowing the operator to manipulate the joystick using the lightest touch while still enabling the functions thereof. Because the capacitive sensing capabilities of the joystick require a mere presence even a gloved hand will be sufficient to activate the joystick regardless of the presence of dirt or moisture on the glove.

The foregoing description of the invention has been made with respect to a representative embodiment of a joystick. Those having skill in the art will recognize that the invention could be embodied in any number of other joystick configurations having different ergonomic characteristics. As such a different ergonomic placement of the hand on an alternative joystick configuration may necessitate a different location for the sensor zones. It is further contemplated that other types of proximity sensors could be used within the scope and spirit of the invention. Those skilled in the art will, therefore, appreciate that the invention herein lies in a joystick having enabling sensors which enable the joystick only when the operator has manually engaged the joystick in a manner consistent with normal operation as described above and not in the specific size or shape of the joystick itself.

Thus it can be seen that the objects of the invention have been satisfied by the structure presented above. While in accordance with the patent statutes, only the best mode and preferred embodiment of the invention has been presented and described in detail, it is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

The embodiments of the invention in which an exclusive property or privilege is claimed are defined as follows:

1. A multi-axis control device comprising a lever operatively connected to an actuator, the lever having a handle portion and at least two sensor zones located at the handle portion, the sensor zones being in communication with the actuator for operatively enabling the actuator when the handle portion of the lever is manually engaged in a manner consistent with normal operation thereof such that a presence is detected in the sensor zones and operatively disabling the actuator when no presence is detected in the sensor zones and wherein a presence must be detected in at least two sensor zones in order to operatively enable the actuator and once the actuator has been enabled the actuator remains enabled provided a presence continues to be detected in at least one sensor zone.

2. A multi-axis control device as set forth in claim 1 wherein the sensor zones are operative to passively detect a presence at the handle portion.

3. A multi-axis control device as set forth in claim 1 further comprising time delay means for enabling the joystick in response to a sensed presence only after a pre-selected period of time has elapsed.

4. A multi-axis control device as set forth in claim 1 wherein the sensor zones are defined by one or more capacitive sensors.

5. A multi-axis control device as set forth in claim 4 wherein the sensors are embedded within the handle portion of the lever.

6. A multi-axis control device as set forth in claim 5 wherein the capacitive sensors have one or more fields defining the sensor zones, the fields being directed outwardly from the handle portion.

7. A multi-axis control device as set forth in claim 6 wherein the field defining one sensor zone is directed outwardly in a direction substantially diametrically opposite to the direction of the field defining another sensor zone.

8. A multi-axis control device as set forth in claim 6 wherein the field defining one sensor zone is non-contiguous with the field defining another sensor zone.

9. A multi-axis control device as set forth in claim 1 wherein the handle portion has a thumb area and a finger area and at least one sensor zone is located proximal to the thumb area and at least one sensor zone is located proximal to the finger area.

10. A multi-axis control device as set forth in claim 1 further comprising time delay means for disabling the joystick in response to a lack of a sensed presence only after a pre-selected period of time has elapsed.

11. A vehicle control device comprising:

a lever operatively connected to an actuator, the lever having a handle portion; and, at least one sensor located at the handle portion, the sensor defining at least two sensor zones in a vicinity of the handle portion, wherein the sensor passively detects a presence in the sensor zones, the sensor being in communication with the actuator so as to operatively enable the actuator when a presence is detected in at least two sensor zones and operatively disable the actuator when no presence is detected in the sensor zones and wherein once the actuator has been enabled the actuator remains enabled provided a presence continues to be detected in at least one sensor zone.

12. A vehicle control device as set forth in claim 11 further comprising time delay means for enabling the joystick in response to a sensed presence only after a pre-selected period of time has elapsed.

13. A vehicle control device as set forth in claim 12 wherein the capacitive sensors have a field defining each sensor zone, the field being directed outwardly from the handle portion and the field defining one sensor zone is directed outwardly in a direction substantially diametrically opposite to the direction of the field defining another sensor zone.

14. A vehicle control device as set forth in claim 13 wherein the field defining one sensor zone is non-contiguous with the field defining another sensor zone.

15. A vehicle control device as set forth in claim 11 wherein the handle portion has a thumb area and a finger area and at least one sensor zone is located proximal to the thumb area and at least one sensor zone is located proximal to the finger area.

16. A vehicle control device as set forth in claim 11 further comprising time delay means for disabling the joystick in response to a lack of a sensed presence only after a pre-selected period of time has elapsed.

17. A vehicle control device as set forth in claim 11 wherein the sensor is a capacitive sensor embedded within the handle portion of the lever.

* * * * *